United States Patent [19]

Chevaux

[11] 3,946,529

[45] Mar. 30, 1976

[54] FLOOR FOR SPORTS AND IN PARTICULAR FOR ROLLER SKATING

[75] Inventor: Jean Chevaux, Renens, Switzerland

[73] Assignee: Roll-Rink S.A., Switzerland

[22] Filed: May 31, 1974

[21] Appl. No.: 475,167

[30] Foreign Application Priority Data

Dec. 7, 1973 Switzerland ..... 17165/73

[52] U.S. Cl. ..... 52/390; 52/480; 52/483; 52/506; 52/177

[51] Int. Cl.[2] ..... E04F 15/00; E04F 13/08

[58] Field of Search ..... 52/177, 311, 385, 386, 52/390, 391, 483, 489, 506, 511, 738

[56] References Cited

UNITED STATES PATENTS

| | | | |
|---|---|---|---|
| 2,195,905 | 4/1940 | Stanley | 52/385 |
| 2,202,568 | 5/1940 | Worden | 52/385 |
| 3,037,596 | 6/1962 | Fordyce | 52/511 |
| 3,129,944 | 4/1964 | Amos et al. | 52/177 |
| 3,174,893 | 3/1965 | Church | 52/311 |
| 3,180,460 | 4/1965 | Liskey | 52/177 |
| 3,504,470 | 4/1970 | Pincemin | 52/385 |
| 3,555,757 | 1/1971 | Volent | 52/390 |
| 3,731,445 | 5/1973 | Hoffmann | 52/391 |
| 3,745,736 | 7/1973 | Fischer | 52/511 |
| 3,828,503 | 8/1974 | Hofmann | 52/390 |

FOREIGN PATENTS OR APPLICATIONS

| | | | |
|---|---|---|---|
| 1,226,666 | 2/1960 | France | 52/385 |

*Primary Examiner*—Frank L. Abbott
*Assistant Examiner*—William Randolph
*Attorney, Agent, or Firm*—D. Paul Weaver

[57] ABSTRACT

A floor for roller skating or other sports activities and the like consists of extruded metal deck sections of a required length which are placed side-by-side on an even solid surface. Juxtaposed plastic tiles or plates are laid down on the deck sections and are provided on their bottoms with press studs which interlock with continuous channels or grooves formed in the deck sections. Each plastic tile or plate engages at least a pair of the underlying deck sections and thus the tiles serve to secure adjacent deck sections in assembled relationship in the formation of a continuous floor.

14 Claims, 4 Drawing Figures

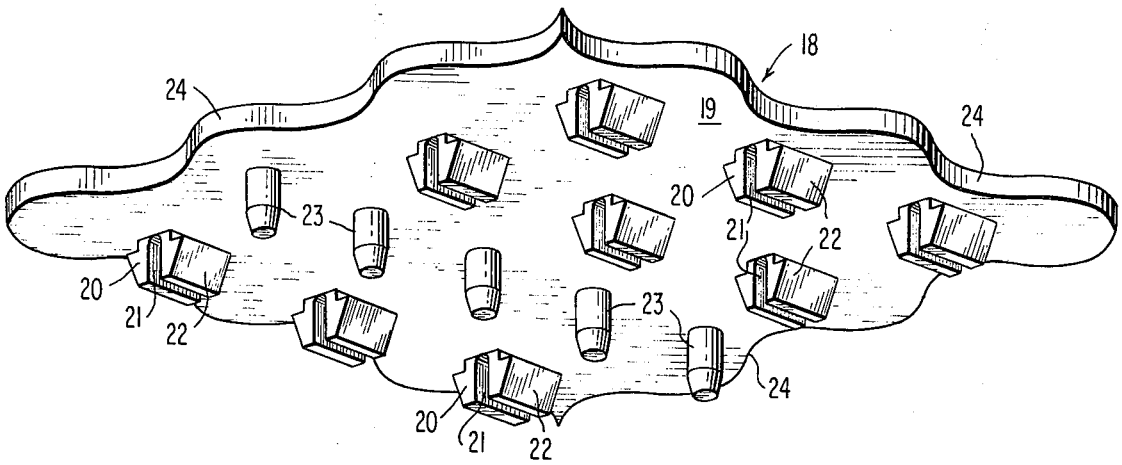
FIG. 1
FIG. 2
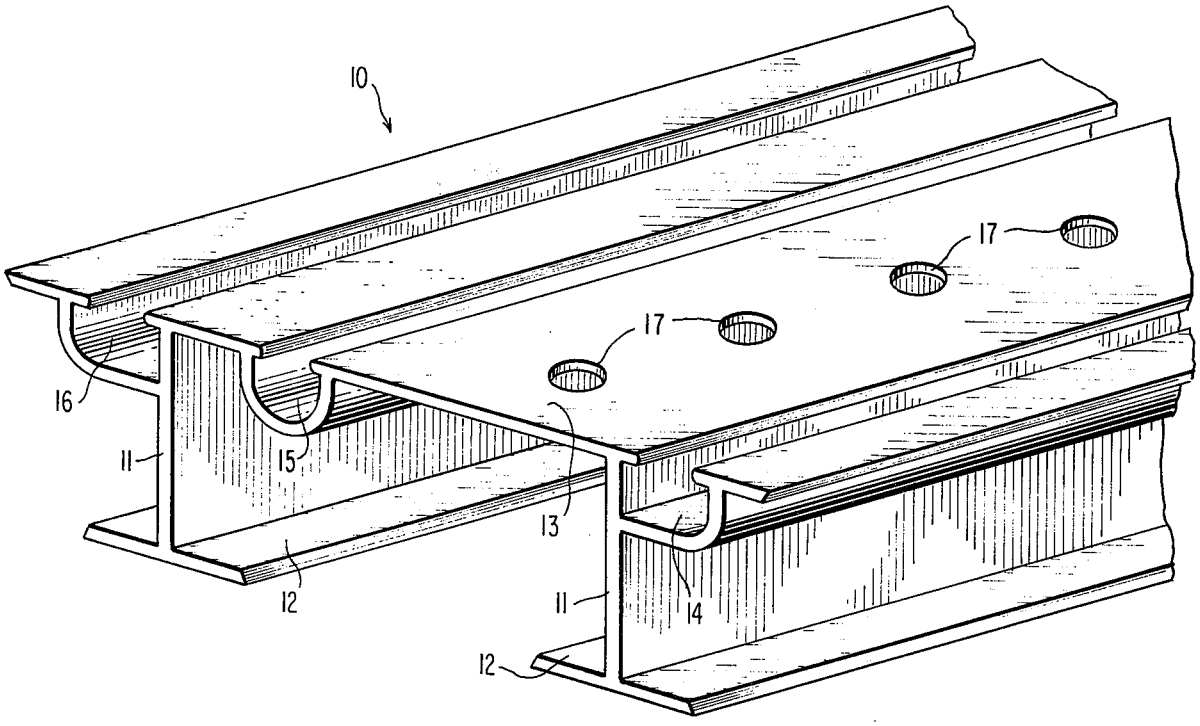

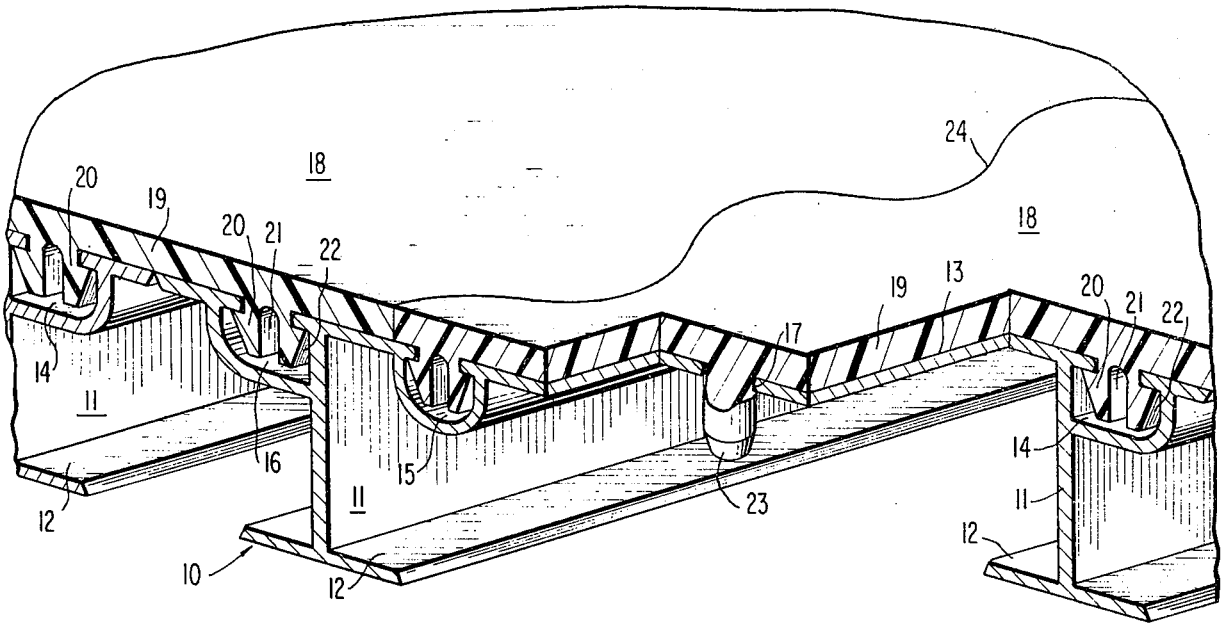
FIG. 3
FIG. 4
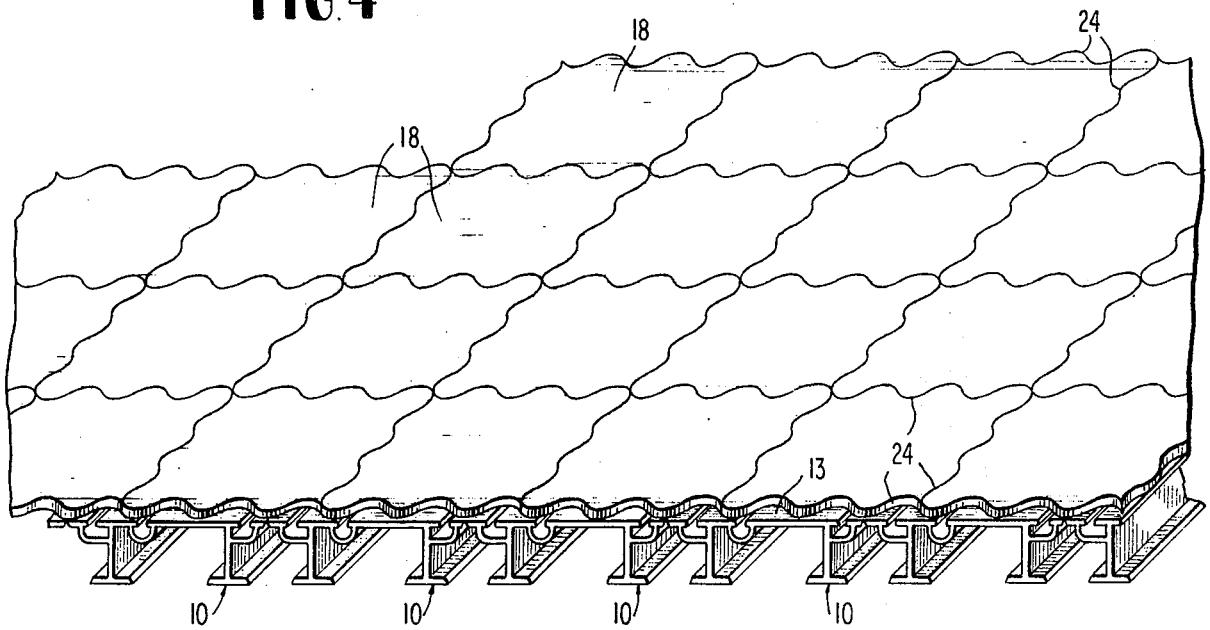

FLOOR FOR SPORTS AND IN PARTICULAR FOR ROLLER SKATING

BACKGROUND OF THE INVENTION

Special flooring for indoor and outdoor sports activities, dancing and other like uses, especially for roller skating, have been proposed in the prior art. Such flooring has been formed from a variety of materials including linoleum, wood, plastic and concrete. Among the drawbacks of such prior art floors are their high initial cost, permanency of installation, and the fact that they must be made and installed on the spot, rather than being prefabricated and carried to an assembly location. Furthermore, the usual floors for sports activities, such as skating, do not wear evenly, resulting in the necessity of repairing large local areas.

In view of the above and other deficiencies of the known prior art, it is the aim of this invention to provide a prefabricated, easily transportable sectional floor for roller skating and many other similar activities which can be quickly assembled and installed in a variety of environments. The flooring embodying the invention consists essentially of underlying extruded aluminum deck sections which can be set down on any solid base, such as a bed of sand or other even supporting surface. The deck sections are placed side-by-side to provide a continuous level supporting face. Rectangular plates, blocks or tiles of tough plastic are adapted to be laid on and lockingly engaged with the deck sections in juxtaposed relation to provide a continuous, smooth and highly wear-resistant floor surface.

The deck sections have spaced parallel grooves which receive similarly spaced rows of press or snap studs molded to the bottoms of the tiles. Additional intervening rows of locator pins on the bottoms of the tiles are received by locator openings of the decking. Each tile rests on and interlocks with at least two deck sections, so that the tiles serve to releasably connect the flooring in assembled relationship. When wear or damage to the flooring occurs, individual tiles may be replaced, as required.

Additionally, the floor constructed under the invention can be rapidly disassembled should it be necessary to remove it for use elsewhere. The floor is weather-resistant, and any water present is not retained but flows away beneath the extruded deck sections. Likewise, the floor is indifferent to humidity changes, and the influences of expansion and contraction due to temperature changes are very minimal. This is in contradistinction to the prior art where floors and skating rinks have been constructed from sections of plastic glued onto plywood plates or the like. In addition to being very expensive, such floors are highly sensitive to temperature and humidity changes and are damaged by the weather. Cracks form during cold weather and curling up occurs at the joints in hot weather. Water infiltrating the joints between blocks causes irreparable damage in the prior art types of floors. In the invention, no adhesives are employed and the materials used inherently resist these factors.

The portability of the floor according to this invention allows it to be installed in many places at a very low cost compared to the prior art. For example, the sturdy extruded metal deck sections forming the base of the flooring could be placed over and across a swimming pool and in many other similar locations.

Other features and advantages of the invention will become apparent during the course of the following description.

BRIEF DESCRIPTION OF DRAWING FIGURES

FIG. 1 is a bottom perspective view of a plastic plate or tile utilized in the invention.

FIG. 2 is a fragmentary perspective view of an extruded metal floor or deck section employed with tiles in the formation of the floor according to the invention.

FIG. 3 is a fragmentary perspective view of an assembled floor in accordance with the invention and showing the interlocking relationship of plastic tiles and supporting deck sections.

FIG. 4 is another fragmentary perspective view on a reduced scale showing flooring in accordance with the invention.

DETAILED DESCRIPTION

Referring to the drawings in detail, the numeral 10 designates an extruded aluminum base or deck section of any required length which is quite rigid but reasonably lightweight in the interest of portability. The deck section 10 includes vertical webs 11 having horizontal feet or webs 12 which may be placed on any stable base, such as a bed of sand. The deck section has a flat level upper plate portion 13 interrupted by preferably three spaced parallel longitudinal grooves or channels 14, 15 and 16, all produced during the extrusion of the unitary base or deck section. A row of openings 17 is produced in the plate 13 between channels 14 and 15 and parallel thereto.

Used in conjunction with a plurality of side-by-side deck sections 10 for producing a floor, as depicted in FIG. 4, are preferably square floor plates or tiles 18 formed of molded or injected plastics material of any well-known tough and durable type which is also wear-resistant and resistant to moisture and humidity and effected little by changes in temperature. Each tile 18 has a flat plate body portion 19 adapted to lie on top of the deck plate 13, and being of the same width as the latter. On its bottom face only, each plastic tile 18 has three spaced parallel rows of connector studs 20 projecting therefrom and formed integrally therewith. These studs are preferably equidistantly spaced in their rows. They are split centrally at 21 for resiliency and have tapered arrow-like heads 22 for entry into the channels or grooves 14, 15 and 16 for interlocking engagement therein, as shown clearly by FIG. 3. The studs 20 are easily caused to snap into the channels 14 by a slight tapping or pressing action on the tiles.

Between two of the three rows of studs 20, each tile 18 has a single row of cylindrical locator pins 23 spaced for entry into the openings 17. The locator pins are somewhat longer than the studs 20 and their main purpose is to pilot or guide the tiles 18 into proper assembly positions with the deck sections 10.

With reference to FIG. 3, it may be observed that each tile 18 engages two side-by-side deck sections 10. The channel or groove 16 of one deck section receives the first row of connector studs 20 of the next adjacent tile 18; the arrangement being such that the adjacent juxtaposed tiles making up an expanse of flooring such as shown in FIG. 4 actually serve to interconnect adjacent deck sections 10 detachably in assembled relationship. Thus, the plastic tiles serve the additional purpose of uniting the sectional floor and holding it together during use but allow its ready separation into sections when required. Also, individual tiles or groups of tiles are easily replaceable after wear or damage. No glue or other adhesive is employed in the assembly and the parts are united solely by mechanical interlocking, as described.

Preferably, but not necessarily, the generally rectangular tiles 18 have wavy marginal edges 24 which interfit snugly in assembly.

The floor surface produced by the tiles 18 may be perfectly smooth or may possess a granular texture. The tiles can be processed to provide an artificial grass surface for sports like tennis and football, in addition to other activities.

Briefly, the floor is set up by placing the deck sections 10 in parallel relation on a suitable base, such as sand or gravel. The tiles 18 are attached to the deck sections by inserting the locator pins 23 in the pilot openings 17 and by tapping or pressing the resilient connector studs 20 into the locking channels or grooves 14, 15 and 16 of the extruded decking. Once assembled, the floor can be carried as a unit or in separated sections to the surface which has been prepared for it.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A floor for roller skating and similar activities comprising a deck formed of shaped parallel deck sections, and a multiplicity of juxtaposed tiles formed of plastics material resting on said sections and having connector studs on their bottoms for interlocking engagement with said deck sections, said deck sections consisting of separately formed elongated parallel members each having a base and an upper flat face portion, the upper flat face portion having plural parallel upwardly open channels, each of said tiles having a flat floor forming upper face and having plural spaced depending connector studs arranged in rows to enter said channels lockingly, each tile adapted to be assembled with at least a pair of said deck sections with at least one row of said connector studs lockingly engaged with a channel of one deck section and the other rows of studs engaged with channels of an adjacent deck section.

2. A floor according to claim 1, wherein the marginal edges of the tiles have a wavy shape.

3. A floor according to claim 1, wherein said connector studs are split vertically.

4. A floor according to claim 1, and a plurality of depending locator pins on each tile engageable in locator openings of the deck sections for positioning tiles in relation thereto.

5. A floor according to claim 1, wherein the top surface of each tile is smooth.

6. A floor according to claim 1, wherein the top surface of each tile is granular.

7. A floor according to claim 1, wherein the top surface of each tile is formed as artificial grass.

8. A floor according to claim 1, wherein the general shape of each tile is square.

9. A floor according to claim 1, wherein the general shape of each tile is polygonal.

10. A floor according to claim 1, wherein each shaped deck section has leg portions terminating at their bottoms in flat base plates.

11. A floor according to claim 1, wherein said deck sections are aluminum alloy extrusions.

12. A floor according to claim 1, and at least one row of depending locator pins on each tile somewhat longer than said connector studs and parallel to the rows of studs and adapted to enter a like row of locator openings in said upper flat face portion of one of said deck sections.

13. A floor according to claim 1, and said connector studs comprising divided stud bodies having enlarged tapered terminals on their lower ends adapted to be forced into the mouths of said channels and to subsequently expand therein and to become interlocked therewith.

14. A floor according to claim 1, and each deck section having three of said channels, each tile being of the same width as the upper flat face portion of each deck section and having three of said spaced depending connector stud rows, whereby two rows of studs on each tile may enter two channels of one deck section and the third row of studs of that tile may enter one channel of an adjacent deck section to thereby interlock the adjacent deck sections in assembled relationship with said tiles.

* * * * *